US010822909B2

(12) United States Patent
Sadana et al.

(10) Patent No.: US 10,822,909 B2
(45) Date of Patent: Nov. 3, 2020

(54) PACKERS HAVING CONTROLLED SWELLING

(71) Applicants: Anil Sadana, Houston, TX (US); Anton Kovalchuk, Houston, TX (US)

(72) Inventors: Anil Sadana, Houston, TX (US); Anton Kovalchuk, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/679,665

(22) Filed: Aug. 17, 2017

(65) Prior Publication Data

US 2019/0055807 A1 Feb. 21, 2019

(51) Int. Cl.

| | |
|---|---|
| ***E21B 33/12*** | (2006.01) |
| ***E21B 33/127*** | (2006.01) |
| *E21B 43/08* | (2006.01) |

(52) U.S. Cl.

CPC ..... *E21B 33/1208* (2013.01); *E21B 33/1277* (2013.01); *E21B 43/08* (2013.01)

(58) Field of Classification Search

CPC ..... E21B 33/1208
USPC ..... 166/387
See application file for complete search history.

(56) References Cited

U.S. PATENT DOCUMENTS

| | | | | |
|---|---|---|---|---|
| 7,681,653 | B2 | 3/2010 | Korte et al. | |
| 7,938,191 | B2 | 5/2011 | Vaidya | |
| 8,191,644 | B2 | 6/2012 | Rytlewski et al. | |
| 9,303,200 | B2 | 4/2016 | Korte et al. | |
| 2004/0020662 | A1 | 2/2004 | Freyer | |
| 2008/0011473 | A1 | 1/2008 | Wood et al. | |
| 2008/0277109 | A1* | 11/2008 | Vaidya | E21B 33/1208 166/118 |
| 2009/0126947 | A1* | 5/2009 | King | E21B 33/1208 166/387 |
| 2009/0131563 | A1* | 5/2009 | Wang | C08B 31/00 524/96 |
| 2010/0243269 | A1 | 9/2010 | Solhaug et al. | |
| 2011/0061862 | A1* | 3/2011 | Loretz | E21B 33/1208 166/250.11 |
| 2011/0147014 | A1* | 6/2011 | Chen | E21B 23/04 166/387 |

(Continued)

FOREIGN PATENT DOCUMENTS

| | | |
|---|---|---|
| EP | 1672166 | 6/2006 |
| WO | 2016171665 | 10/2016 |

OTHER PUBLICATIONS

"Hollow glass fibres (H-glass)", Faserverbundwerkstoffe® Composite Technology, Jun. 2010 (1 page).

(Continued)

*Primary Examiner* — Taras P Bemko
(74) *Attorney, Agent, or Firm* — Cantor Colburn LLP

(57) ABSTRACT

A sealing system for a flow channel is disclosed. The sealing system includes a mandrel; a swellable element disposed about the mandrel; and a swell control element disposed on a surface of the swellable element and configured to delay swelling of the swellable element. The swell control element contains a polymeric matrix that is impermeable to oil, water, or a combination thereof; and a channel inducer dispersed in the polymeric matrix, the channel inducer including carbon nanotubes, a hollow fiber, an oil swellable material, or a combination comprising at least one of the foregoing.

16 Claims, 2 Drawing Sheets

(56) References Cited

U.S. PATENT DOCUMENTS

| | | | | |
|---|---|---|---|---|
| 2013/0227986 | A1 | 9/2013 | Sadler et al. | |
| 2014/0102726 | A1 | 4/2014 | Gamstedt et al. | |
| 2014/0102728 | A1* | 4/2014 | Gamstedt | E21B 33/1208 166/387 |
| 2015/0114646 | A1* | 4/2015 | Price Hoelscher | E21B 33/138 166/302 |
| 2016/0281454 | A1* | 9/2016 | Zhu | E21B 33/12 |
| 2016/0289510 | A1 | 10/2016 | Seyger | |
| 2016/0326829 | A1* | 11/2016 | Dolog | E21B 33/1277 |
| 2017/0015824 | A1* | 1/2017 | Gozalo | C09K 8/44 |
| 2018/0119510 | A1* | 5/2018 | Yu | E21B 33/128 |
| 2018/0230358 | A1* | 8/2018 | Jain | C04B 24/2611 |

OTHER PUBLICATIONS

International Search Report, International Application No. PCT/US2018/042279, dated Oct. 23, 2018, Korean Intellectual Property Office; International Search Report 4 pages.

International Written Opinion, International Application No. PCT/US2018/042279, dated Oct. 23, 2018, Korean Intellectual Property Office; International Written Opinion 7 pages.

Trask et al. "Biomimetic self-healing of advanced composite structures using hollow glass fibres", Smart Mater. Struct. 15 (2006) 704-710.

* cited by examiner

PACKERS HAVING CONTROLLED SWELLING

BACKGROUND

Isolation of downhole environments depends on the deployment of a downhole tool that effectively seals the entirety of the borehole or a portion thereof, for example, an annulus between a casing wall and production tube. Swellable packers are particularly useful in that they are capable of generating a contact force against a nearby structure when exposed to one or more downhole fluids such as water, oil, or a combination thereof. Compared with mechanically setup packers and inflatable packers, fluid-swellable packers are easier to set up.

Oil swellable packers normally contain an elastomer such as ethylene propylene diene monomer (EPDM) that expands when exposed to hydrocarbon based fluids. EPDM rubber often swells rapidly in the oil or oil based fluids and can seal a borehole within one or two days at elevated temperatures. However, under certain circumstances, it is desirable to delay the swelling of the packers to allow the operator to have more time to carry out various completion operations. Such delayed swelling period can be a few days or weeks. Thus, alternative sealing elements having controlled swelling are desired in the art.

BRIEF DESCRIPTION

A sealing system for a flow channel comprises a mandrel; a swellable element disposed about the mandrel; and a swell control element disposed on a surface of the swellable element and configured to delay swelling of the swellable element; wherein the swell control element comprises a polymeric matrix that is impermeable to oil, water, or a combination thereof; and a channel inducer dispersed in the polymeric matrix, the channel inducer comprising carbon nanotubes, a hollow fiber, a degradable polymer, an oil swellable material, or a combination comprising at least one of the foregoing.

A method of sealing using the sealing system is also disclosed. The method comprises disposing the sealing system in a wellbore; and allowing the swelling element to swell upon contact with a fluid permeated through the swell control element.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
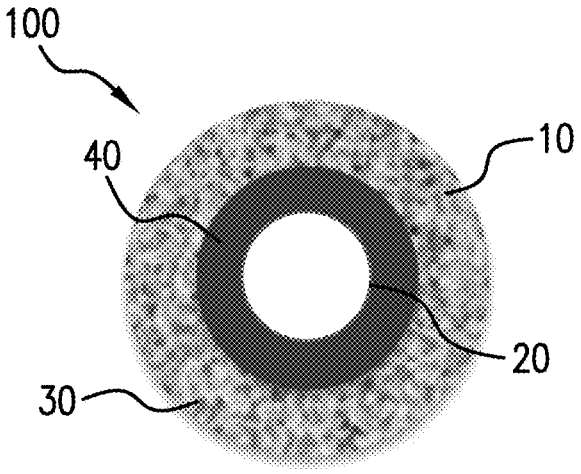
FIG. 1 is a cross-sectional view of an exemplary sealing system having a mandrel that bears a swellable element and a swell control element disposed on a surface of the swellable element.

The inventors hereof have discovered that a swell control element can be formed on a surface of a swellable element to delay and control the swelling rate of the swellable element. As shown in FIG. 1, a sealing system 100 includes a mandrel 20, a swellable element 40 disposed about the mandrel 20, and a swell control element 30 disposed on a surface of the swellable element 40 and configured to delay swelling of the swellable element 40.

The swell control element comprises a polymeric matrix that is not permeable to oil, water, or a combination thereof, and a channel inducer dispersed in the polymeric matrix.

Advantageously, the swell control element encapsulates the swellable element and prevents the swellable element from direct contact with a downhole fluid. Because the swellable element is not in direct contact with downhole fluids, its swelling can be effectively delayed. In addition, without wishing to be bound by theory, it is believed that the channel inducer facilitates the formation of channels in the swell control element. As used herein, channels are not particularly limited and include any diffusion pathways in the swell control element. Due to capillary effects, downhole fluids are allowed to permeate the swell control element through the channels in a controlled manner to reach the swellable element. By tuning the permeability of the swell control element, the swelling rate of the swellable element can be tuned.

The swell control element can be in the form of a layer having an average thickness of about 0.1 mm to about 15 mm, specifically about 1.5 mm to about 15 mm, more specifically about 1.5 mm to about 7 mm. The swell control element can be chemically and/or physically bonded to the swellable element. In an embodiment, the swell control element and the swellable element are seamlessly bonded together forming a single piece during a cure procedure. The swell control element does not have any apertures.

The polymeric matrix is elastic and mechanically strong enough to enable expansion of the swellable element without rupture. Exemplary polymeric matrix comprises acrylonitrile butadiene rubber (NBR), hydrogenated acrylonitrile butadiene rubber (HNBR), fluorinated polymer rubbers (e.g. FKM), perfluorocarbon rubber (FFKM), tetrafluoro ethylene propylene rubbers (FEPM, such as AFLAS™ fluoroelastomers available from Asahi Glass Co. Ltd.). Combinations of the matrix materials can be used.

The channel inducer can be present in the swell control element in an amount from 1 wt. % to 50 wt. %, 5 wt. % to 35 wt. %, 0.1 wt. % to 20 wt. %, or 5 wt. % to 20 wt. %, based on a weight of the swell control element.

The channel inducer can be any shape and size. The channel inducer can be crystals, fibers, or grains of various sizes, and the channel inducer can be in a powder form. In an embodiment, a size, e.g., a diameter or smallest linear dimension, of the channel inducer is from 50 μm to 500 μm, specifically 75 μm to 500 μm, and more specifically 100 μm to 450 μm.

The carbon nanotube can further be functionalized to include grafts or functional groups to adjust properties such as solubility, surface charge, hydrophilicity, lipophilicity, and other properties. Exemplary functional groups include, for example, carboxy (e.g., carboxylic acid groups), epoxy, ether, ketone, amine, hydroxy, alkoxy, alkyl, aryl, aralkyl, alkaryl, lactone, functionalized polymeric or oligomeric groups, and the like.

Hollow fibers include glass hollow fibers such as H-glass hollow fibers, carbon hollow fibers, polymeric fibers, or a combination comprising at least one of the foregoing. As used herein, hollow fibers include chopped fibers. The hollow fibers can have an average outer diameter of about 5 microns to about 100 microns and an average inner capillary tunnel diameter of about 1 to about 10 microns.

Degradable polymers include biodegradable polymers comprising polyglycolic acid; cellulose and its chemical derivatives such as carboxymethylcellulose (CMC), hydroxyethylcellulose (HEC), hydroxypropylcellulose (HPC), and carboxymethylhydroxyethylcellulose (CMHEC), hydropropyl starch, lignosulfonate, and other modifications; chitosan; polyacrylic acid and its salts; polyhydroxybutyrate; polylactic acid; polycaprolactone; polyphosphazenes; or a combination comprising at least one of the foregoing.

In an embodiment, the channel inducer comprises a swellable material such as an oil swellable material. Suitable swellable material comprises ethylene propylene diene monomer, styrene butadiene rubber, synthetic rubber based on polychloroprene, fluorosilicone rubber, isobutylene-isoprene rubber, or a combination comprising at least one of the foregoing. The swellable material can be the same or different from the material in the swellable element.

The swellable element provides excellent swelling volumes when exposed to oil, water, or a combination comprising at least one of the foregoing. Oil swellable element can contain an elastomer such as ethylene propylene diene monomer (EPDM), styrene butadiene rubber (SBR), synthetic rubbers based on polychloroprene (NEOPRENE™ polymers from DuPont), fluorosilicone rubber (FVMR), butyl rubbers (isobutylene-isoprene rubber IIR), and the like.

Water swellable element can include the elastomer as described herein such as NBR and a super absorbent material. NBR can be crosslinked. The crosslinks are a product of crosslinking the polymer by sulfur, peroxide, urethane, metallic oxides, acetoxysilane, and the like. In particular, a sulfur or peroxide crosslinker is used.

Additives such as fillers, activators, antioxidants, processing acids, and curatives can be included in the swellable element. Known additives are described for example in U.S. Pat. No. 9,303,200.

In a specific embodiment, the swellable element comprises ethylene propylene diene monomer, styrene butadiene rubber, or a combination comprising at least one of the foregoing; and the swell control element comprises, based on the total weight of the swell control element about 80% to about 99.9% of acrylonitrile butadiene rubber as the polymeric matrix, and about 0.1% to about 20% of carbon nanotubes, a hollow fiber, or a combination thereof as the channel inducer.

In another specific embodiment, the swellable element comprises ethylene propylene diene monomer, styrene butadiene rubber, or a combination comprising at least one of the foregoing; and the swell control element comprises, based on the total weight of the swell control element about 70% to about 99% of acrylonitrile butadiene rubber as the polymeric matrix, and about 1% to about 30% of cellulose as the channel inducer.

In yet another specific embodiment, the swellable element comprises ethylene propylene diene monomer, styrene butadiene rubber, or a combination comprising at least one of the foregoing; and the swell control element comprises, based on the total weight of the swell control element, about 50% to about 99% of hydrogenated acrylonitrile butadiene rubber as the polymeric matrix, and about 1% to about 50% of ethylene propylene diene monomer as the channel inducer.

The sealing system can be manufactured by making the swellable element and the swell control element separately then laminating the two components together via molding, calendaring, or other methods known in the art. A binder is optionally used to bond the swellable element to the swell control element. The curing process can be performed either in two stages by curing the swellable elastomer layer first, and then applying bonding agent, attaching an outer layer and finally curing the whole packer or by curing both layers together in a single heating stage. The swellable element and the swell control element can be chemically bonded after cuing.

Figure 4:
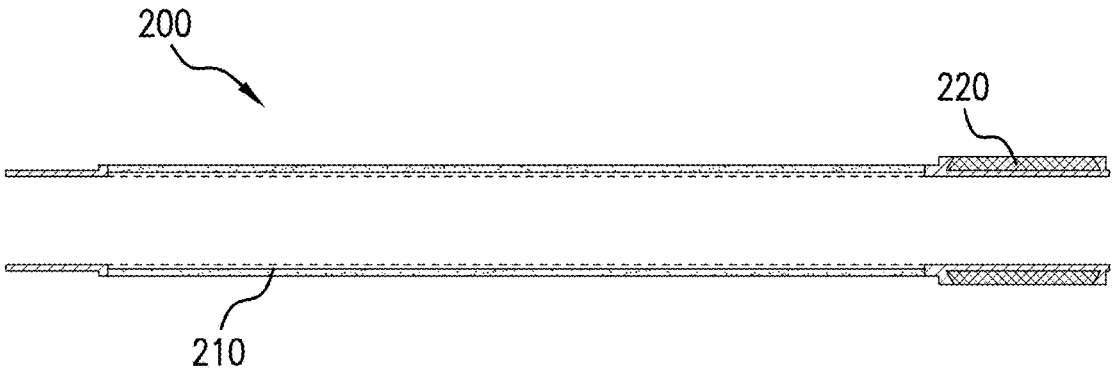
FIG. 4 illustrates a sealing system which contains a sand screen.

The sealing system can be various downhole tools or a component of various downhole tools. In an embodiment, the sealing system is a packer or a component of a sand screen. An exemplary downhole tool is shown in FIG. 4. The tool 200 includes a screen portion 210 and a seal portion 220. The tool can be disposed of a base pipe with end connections to attach to a pipe string and a portion that is perforated or slotted (not shown). The seal portion 220 can include any substrate that are effective to filter the formation solids from produced fluids. Exemplary screen portion includes a slotted liner, a wire wrapped screen, or a mesh. The seal portion 220 can be a sealing system as disclosed herein.

The sealing system can be used to seal a wellbore. The method comprises disposing the sealing system in a wellbore; and allowing the swelling element to swell upon contact with a fluid permeated through the swell control element.

The fluid can comprise a hydrocarbon, water, brine, an acid, a base, or a combination comprising at least one of the foregoing. The brine can include NaCl, KCl, NaBr, $MgCl_2$, $CaCl_2$, $CaBr_2$, $ZnBr_2$, $NH_4Cl$, sodium formate, cesium formate, and the like. The fluid can be a wellbore fluid generated downhole. Alternatively, to further control the swelling profile of swellable element, a fluid such as an acid can be introduced downhole to accelerate the degradation of the degradable element at the time when sealing is desired. In an embodiment the fluid is a drilling fluid or a completion fluid.

Depending on the time needed to finish the completion operations, the sealing system can seal a wellbore in less than or equal to about 25 days, in less than or equal to about 20 days, or in less than or equal to about 15 days at a temperature of about 25° C. to about 300° C., about 65° C. to about 250° C., or about 65° C. to about 150° C. or about 175° C. to about 250° C., and a pressure of about 650 kPa to about 100,000 kPa. Advantageously, the sealing system seals a wellbore at least three days, at least five days, or at least one week after the sealing system is deployed downhole. In an embodiment, the polymeric matrix, the channel inducer, and swellable element are selected such that a diameter of the swellable element increases less than about 25% after the sealing system is exposed to a downhole fluid for greater than 14 days at about 100° C.

Various samples having a swellable element and a swell control element as disclosed herein are made and evaluated. The samples were placed insider a pressure cell, which was filled with an oil based drilling mud having about 20% water by weight. The pressure cell was heated to about 100° C., and the diameters of the samples were measured. A control without the swell control element was also tested.

Figure 2:
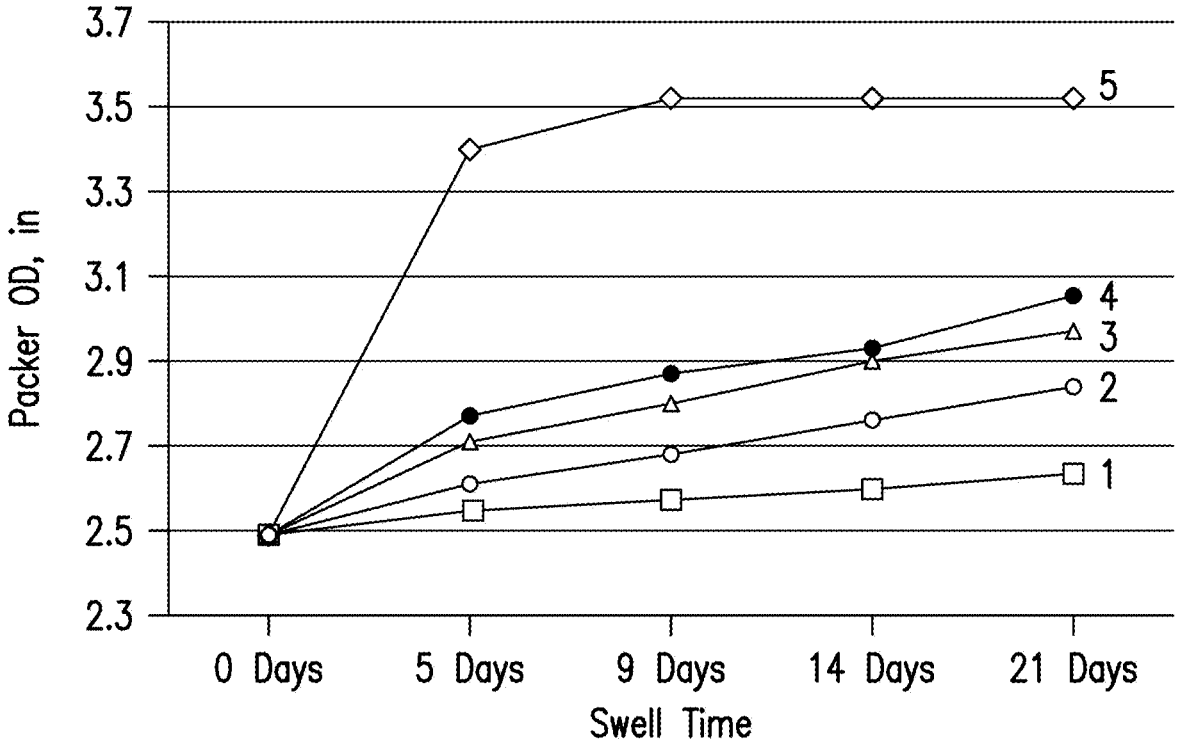
FIG. 2 shows swell data profiles for packer prototypes having an ethylene propylene diene monomer (EPDM) core with a shell of (1) acrylonitrile butadiene rubber (NBR), (2) hydrogenated acrylonitrile butadiene rubber (HNBR)/EPDM rubber blend, (3) NBR/cellulose blend, or (4) NBR/carbon nanotubes (CNT) blend; or (5) without any shells, when tested at 220° F. in an oil-based drilling mud.

FIG. 2 shows swell data profiles for the packer prototypes composed of EPDM swelling core and various outer layers. The figure shows that by tuning the permeability of an oil-resistant outer layer in a dual-layer packer, the swell rate of the core can be effectively controlled. In particular, an NBR rubber outer layer was found almost impermeable to an oil and provided insufficient swelling. HNBR/EPDM rubber blend with a low EPDM content provided very slow packer swell with sufficient swelling performance. NBR/cellulose blend and NBR/CNT blend provided more rapid packer swelling. As a reference, single layer EPDM swelling element without any oil-resistant outer layer has rapid swell and most swell occurs within first five days.

Figure 3:
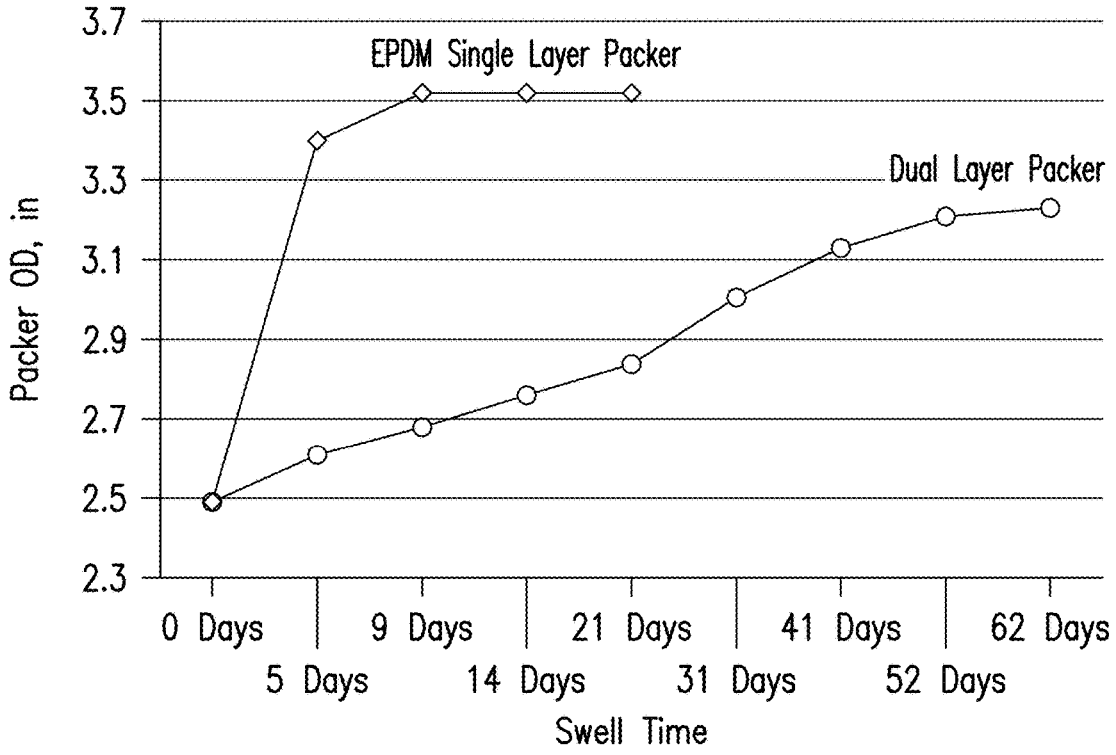
FIG. 3 compares the extended swell profile of a packer prototype having an EPDM core and HNBR/EPDM rubber blend shell with the swell profile of a packer prototype having an EPDM core only, wherein all the packer prototypes were tested in an oil-based drilling mud at 220° F. for the first 21 days and in LVT 200 oil for the remaining period (22-62 days)

FIG. 3 shows extended swell profile for the packer prototype composed of the EPDM swelling core and HNBR/EPDM rubber blend outer layer and swell profile for the single layer EPDM packer. After 21 days of the initial swell test in an oil based mud, the test fluid was changed to LVT 200 oil in order to simulate downhole production fluid. The final swell of the packer prototype was measured. The results indicate that the swell control element can effectively delay swelling of the swellable element.

Set forth are various embodiments of the disclosure.

Embodiment 1. A sealing system for a flow channel comprising: a mandrel; a swellable element disposed about the mandrel; and a swell control element disposed on a surface of the swellable element and configured to delay swelling of the swellable element; wherein the swell control element comprises a polymeric matrix that is impermeable to oil, water, or a combination thereof; and a channel inducer dispersed in the polymeric matrix, the channel inducer comprising carbon nanotubes, a hollow fiber, a swellable material, a degradable polymer, or a combination comprising at least one of the foregoing.

Embodiment 2. The sealing system as in any prior embodiment, wherein the swell control element has an average thickness of about 1.5 mm to about 15 mm.

Embodiment 3. The sealing system as in any prior embodiment, wherein the swell control element is chemically bonded to the swellable element.

Embodiment 4. The sealing system as in any prior embodiment, wherein the swell control element is physically bonded to the swellable element.

Embodiment 5. The sealing system as in any prior embodiment, wherein the swell control element encapsulates the swellable element and prevents the swellable element from direct contact with a downhole fluid.

Embodiment 6. The sealing system as in any prior embodiment, wherein the polymeric matrix of the swell control element comprises an acrylonitrile butadiene rubber, a hydrogenated acrylonitrile butadiene rubber, a fluorinated polymer rubber, a perfluorocarbon rubber, a tetrafluoro ethylene propylene rubber, a polyphenylene sulfide, or a combination comprising at least one of the foregoing.

Embodiment 7. The sealing system as in any prior embodiment, wherein the channel inducer is present in an amount of about 0.1% to about 20 wt. % based on the total weight of the swell control element.

Embodiment 8. The sealing system as in any prior embodiment, wherein the channel inducer comprises the degradable polymer, the degradable polymer being a biodegradable polymer comprising polyglycolic acid, cellulose, a cellulose derivative, chitosan, polyacrylic acid, a salt of a polyacrylic acid, polyhydroxybutyrate, polylactic acid, polycaprolactone, polyphosphazenes, or a combination comprising at least one of the foregoing. Alternatively or in addition, the channel inducer comprises the swellable material, the swellable material comprising ethylene propylene diene monomer, styrene butadiene rubber, synthetic rubber based on polychloroprene, fluorosilicone rubber, isobutylene-isoprene rubber, or a combination comprising at least one of the foregoing.

Embodiment 9. The sealing system as in any prior embodiment, wherein the swellable element comprises ethylene propylene diene monomer, styrene butadiene rubber, synthetic rubber based on polychloroprene, fluorosilicone rubber, isobutylene-isoprene rubber, or a combination comprising at least one of the foregoing.

Embodiment 10. The sealing system as in any prior embodiment, wherein the swellable element comprises ethylene propylene diene monomer, styrene butadiene rubber, or a combination comprising at least one of the foregoing; and the swell control element comprises, based on the total weight of the swell control element about 80 wt % to about 99.9 wt % of acrylonitrile butadiene rubber as the polymeric matrix, and about 0.1 wt % to about 20 wt % of carbon nanotubes, the hollow fiber, or a combination thereof as the channel inducer.

Alternatively, in the sealing system as in any prior embodiment, the swellable material comprises ethylene propylene diene monomer, styrene butadiene rubber, or a combination comprising at least one of the foregoing; and the swell control element comprises, based on the total weight of the swell control element about 70 wt. % to about 90 wt. % of acrylonitrile butadiene rubber as the polymeric matrix, and about 1 wt % to about 30 wt % of cellulose as the channel inducer.

In the sealing system as in any prior embodiment, the swellable material can also comprise ethylene propylene diene monomer, styrene butadiene rubber, or a combination comprising at least one of the foregoing; and the swell control element comprises, based on the total weight of the swell control element about 50 wt % to about 99 wt % of hydrogenated acrylonitrile butadiene rubber as the polymeric matrix, and about 1 wt % to about 50 wt % of ethylene propylene diene monomer as the channel inducer.

Embodiment 11. The sealing system as in any prior embodiment, wherein the polymeric matrix, the channel inducer, and the swellable element are selected such that a diameter of the swellable element increases less than about 25% after the sealing system is exposed to a downhole fluid for greater than 14 days at about 100° C.

Embodiment 12. The sealing system as in any prior embodiment, wherein the sealing system is a packer or a component of a sand screen.

Embodiment 13. A method of sealing, the method comprising: disposing a sealing system in a wellbore; the sealing system comprising: a mandrel; a swellable element disposed about the mandrel; and a swell control element disposed on a surface of the swellable element and configured to delay swelling of the swellable element; the swell control element comprising a polymeric matrix that is impermeable to oil, water, or a combination thereof; and a channel inducer dispersed in the polymeric matrix, the channel inducer comprising carbon nanotubes, a hollow fiber, a degradable polymer, a swellable material, or a combination comprising one or more of the foregoing; and allowing the swelling element to swell upon contact with a downhole fluid permeated through the swell control element.

Embodiment 14. The method as in any prior embodiment, wherein the downhole fluid comprises a hydrocarbon, water, brine, an acid, a base, or a combination comprising at least one of the foregoing.

Embodiment 15. The method as in any prior embodiment, wherein the downhole fluid is generated downhole.

Embodiment 16. The method as in any prior embodiment, wherein the downhole fluid is introduced into a wellbore. The downhole fluid is a completion fluid or a drilling fluid.

Embodiment 17. The method as in any prior embodiment, wherein the polymeric matrix of the swell control element comprises an acrylonitrile butadiene rubber, a hydrogenated acrylonitrile butadiene rubber, a fluorinated polymer rubber, a perfluorocarbon rubber, a tetrafluoro ethylene propylene rubber, a polyphenylene sulfide, or a combination comprising at least one of the foregoing.

Embodiment 18. The method as in any prior embodiment, wherein the channel inducer is a degradable polymer, the degradable polymer being a biodegradable polymer comprising polyglycolic acid, cellulose, a cellulose derivative, chitosan, polyacrylic acid, a salt of a polyacrylic acid, polyhydroxybutyrate, polylactic acid, polycaprolactone, polyphosphazenes, or a combination comprising at least one of the foregoing.

Embodiment 19. The method as in any prior embodiment, wherein the channel inducer comprises the swellable material, the swellable material comprising ethylene propylene diene monomer, styrene butadiene rubber, synthetic rubber based on polychloroprene, fluorosilicone rubber, isobutylene-isoprene rubber, or a combination comprising at least one of the foregoing.

All ranges disclosed herein are inclusive of the endpoints, and the endpoints are independently combinable with each other. As used herein, "combination" is inclusive of blends, mixtures, alloys, reaction products, and the like. All references are incorporated herein by reference.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." The modifier "about" used in connection with a quantity is inclusive of the stated value and has the meaning dictated by the context (e.g., it includes the degree of error associated with measurement of the particular quantity).

What is claimed is:

1. A sealing system for a flow channel comprising:

a mandrel;

a swellable element disposed about the mandrel, the swellable element comprising one or more of ethylene propylene diene monomer, or styrene butadiene rubber; and a swell control element disposed on a surface of the swellable element and configured to delay swelling of the swellable element;

wherein the swell control element comprises, based on the total weight of the swell control element:

80 wt % to 99.9 wt % of a polymeric matrix that is impermeable to oil, water, or a combination thereof, the polymer matrix comprising an acrylonitrile butadiene rubber; and 0.1 wt % to 20 wt % of a channel inducer dispersed in the polymeric matrix, the channel inducer comprising carbon nanotubes or a combination of carbon nanotubes and a hollow fiber.

2. The sealing system of claim 1, wherein the swell control element has an average thickness of 1.5 mm to 15 mm.

3. The sealing system of claim 1, wherein the swell control element is chemically bonded to the swellable element.

4. The sealing system of claim 1, wherein the swell control element is physically bonded to the swellable element.

5. The sealing system of claim 1, wherein the swell control element encapsulates the swellable element and prevents the swellable element from direct contact with a downhole fluid.

6. The sealing system of claim 1, wherein the sealing system is a packer or a component of a sand screen.

7. The sealing system of claim 1, wherein the channel inducer is free of degradable polymers.

8. A sealing system of for a flow channel comprising:

a mandrel;

a swellable element disposed about the mandrel, the swellable element comprising one or more of the following: ethylene propylene diene monomer, styrene butadiene rubber, synthetic rubber based on polychloroprene, fluorosilicone rubber, or isobutylene-isoprene rubber; and a swell control element disposed on a surface of the swellable element and configured to delay swelling of the swellable element;

wherein the swell control element comprises a polymeric matrix that is impermeable to oil, water, or a combination thereof; and a channel inducer dispersed in the polymeric matrix;

wherein the swell control element comprises, based on the total weight of the swell control element:

50 wt % to 99 wt % of hydrogenated acrylonitrile butadiene rubber as the polymeric matrix, and 1 wt % to 50 wt % of ethylene propylene diene monomer as the channel inducer.

9. A method of sealing, the method comprising:

disposing a sealing system of claim 8 in a wellbore and allowing the swelling element to swell upon contact with a downhole fluid permeated through the swell control element.

10. The method of claim 9, wherein the downhole fluid comprises a hydrocarbon, water, brine, an acid, a base, or a combination comprising at least one of the foregoing.

11. The method of claim 9, wherein the downhole fluid is generated downhole.

12. The method of claim 9, wherein the downhole fluid is introduced into a wellbore.

13. The method of claim 9, wherein the downhole fluid is a completion fluid or a drilling fluid.

14. The sealing system of claim 8, wherein the swellable element comprises ethylene propylene diene monomer.

15. A sealing system for a flow channel comprising:

a mandrel;

a swellable element disposed about the mandrel; and a swell control element disposed on a surface of the swellable element and configured to delay swelling of the swellable element;

wherein the swell control element comprises a polymeric matrix that is impermeable to oil, water, or a combination thereof; and a channel inducer dispersed in the polymeric matrix, wherein the channel inducer comprises a hollow fiber having an average inner capillary tunnel diameter of 1 to 10 microns or a combination of the hollow fiber, having an average inner capillary tunnel diameter of 1 to 10 microns, and carbon nanotubes, and the channel inducer is present in an amount of 0.1 to 20 wt. % based on the total weight of the swell control element.

16. The sealing system of claim 15, wherein the hollow fiber comprising a glass hollow fiber, a carbon hollow fiber, or a combination comprising at least one of the foregoing.

* * * * *